United States Patent [19]

Wright

[11] 4,048,785

[45] Sept. 20, 1977

[54] APPARATUS FOR DEPOSITING FIBROUS MATERIAL INTO CONTAINERS

[75] Inventor: Edward James Wright, Peterborough, England

[73] Assignee: Baker Perkins Holdings Limited, Peterborough, England

[21] Appl. No.: 706,701

[22] Filed: July 19, 1976

[51] Int. Cl.[2] ..... B65B 63/02

[52] U.S. Cl. ..... 53/122; 17/32; 53/123

[58] Field of Search ..... 53/122, 123; 17/32; 141/71

[56] References Cited

U.S. PATENT DOCUMENTS

| | | | |
|---|---|---|---|
| 1,545,513 | 7/1925 | Peters et al. | 53/122 X |
| 2,939,407 | 6/1960 | Keathley et al. | 17/32 X |
| 3,462,911 | 8/1969 | Schmidt | 53/122 |
| 3,864,891 | 2/1975 | Piereder | 53/122 X |

*Primary Examiner*—Travis S. McGehee

*Attorney, Agent, or Firm*—Learman & McCulloch

[57] ABSTRACT

Apparatus for depositing fibrous material into containers wherein a predetermined amount of fibrous material is extruded from a chamber holding the main mass of material into a slidable member mounted for reciprocal movement with respect to the chamber. The sliding member is movable to shear the predetermined extruded amount from the main mass and permit it to be deposited into receiving containers.

1 Claim, 4 Drawing Figures

APPARATUS FOR DEPOSITING FIBROUS MATERIAL INTO CONTAINERS

The present invention relates to apparatus for depositing materials such as meat in predetermined amounts in containers.

Materials of the above type having a high content of connective sinew such as uncooked coarse chopped meat, and those containing adhesive substances such as emulsified fat, present handling problems, and difficulty for example is experienced during separation of an extruded portion of the material from the main mass. It will be appreciated that this can result in inaccuracy between the amounts of material required to be deposited and the amounts of material actually extruded and deposited in the containers.

According to the invention therefore there is provided apparatus for despositing a predetermined amount of material such as meat into a container comprising extrusion means for extruding a predetermined portion of material from the body of a mass of material at an extrusion position, slide means for receiving and holding said portion of extruded material at the extrusion position and mounted for movement with respect to said extrusion means from said extrusion position to an ejecting position to shear and separate connective sinews of the extruded portion from the body of said mass of material and convey said portion to said ejecting position, and ejecting means operatively mounted at said ejecting position for ejecting said portion of material from the slide means into the container.

The ejecting means may comprise an air actuated cylinder piston arrangement which operates to eject the portion of material from the slide means when the slide means moves to said ejecting position.

Moreover the piston may be mounted for continuous subsequent movement after ejecting the portion of material for compacting the material in the container.

The leading end of the piston may be provided with a perforated cap for releasing a blast of clean air during the compaction mode of the piston.

The invention will now be described by way of example with reference to the accompanying drawings wherein.

Figure 1:
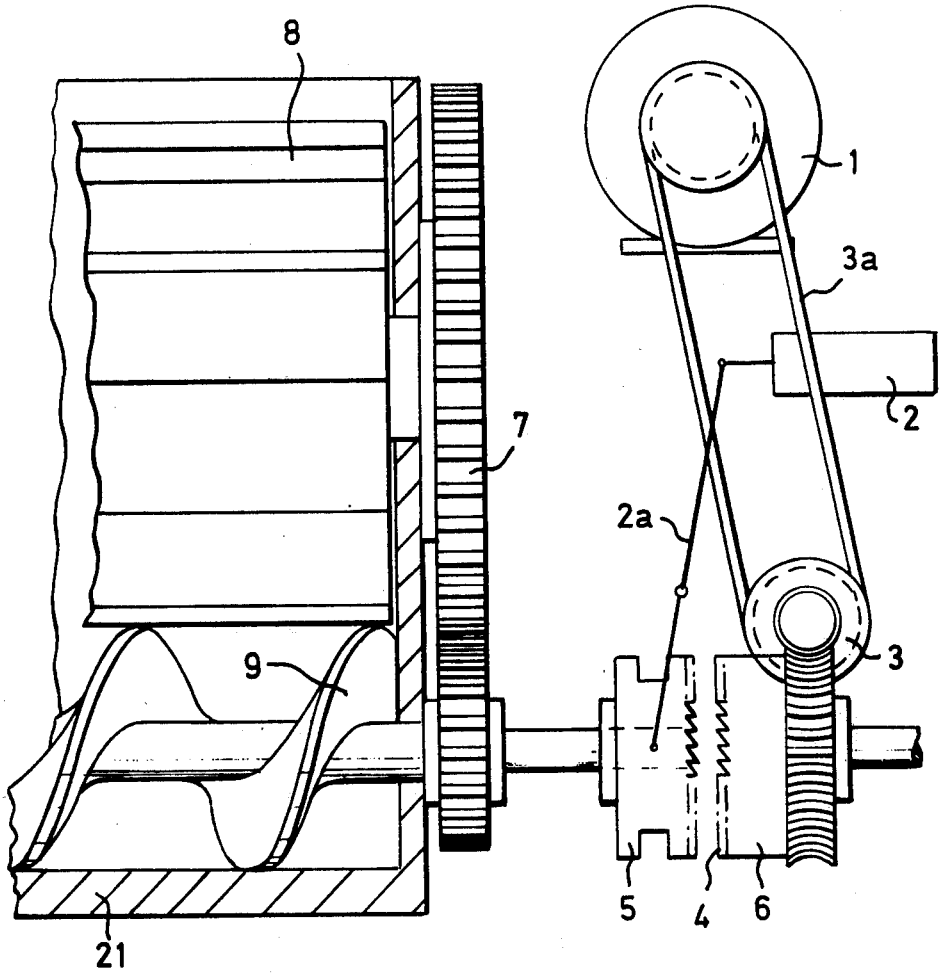
FIG. 1 shows a drive arrangement for an extruder mechanism.

With reference to FIG. 1 there is shown a drive arrangement for an extruder mechanism wherein a motor 1 is drivably coupled to a reduction gear 3 through a vee belt 3*a*.

One side 6 of a dog clutch 4 is attached to the reduction gear 3, the other side 5 to an air cylinder 2 via a clutch lever 2*a*. The air cylinder 2 thus operates through the lever 2*a* to engage the dog clutch 4 at a desired time.

The side 5 of the clutch 4 is also keyed to an extruder screw 9 to drive the screw when the clutch is engaged. A gear drive 7 couples the screw 9 to a feed roll 8 to transmit rotation of the screw to the feed roll.

Figure 3:
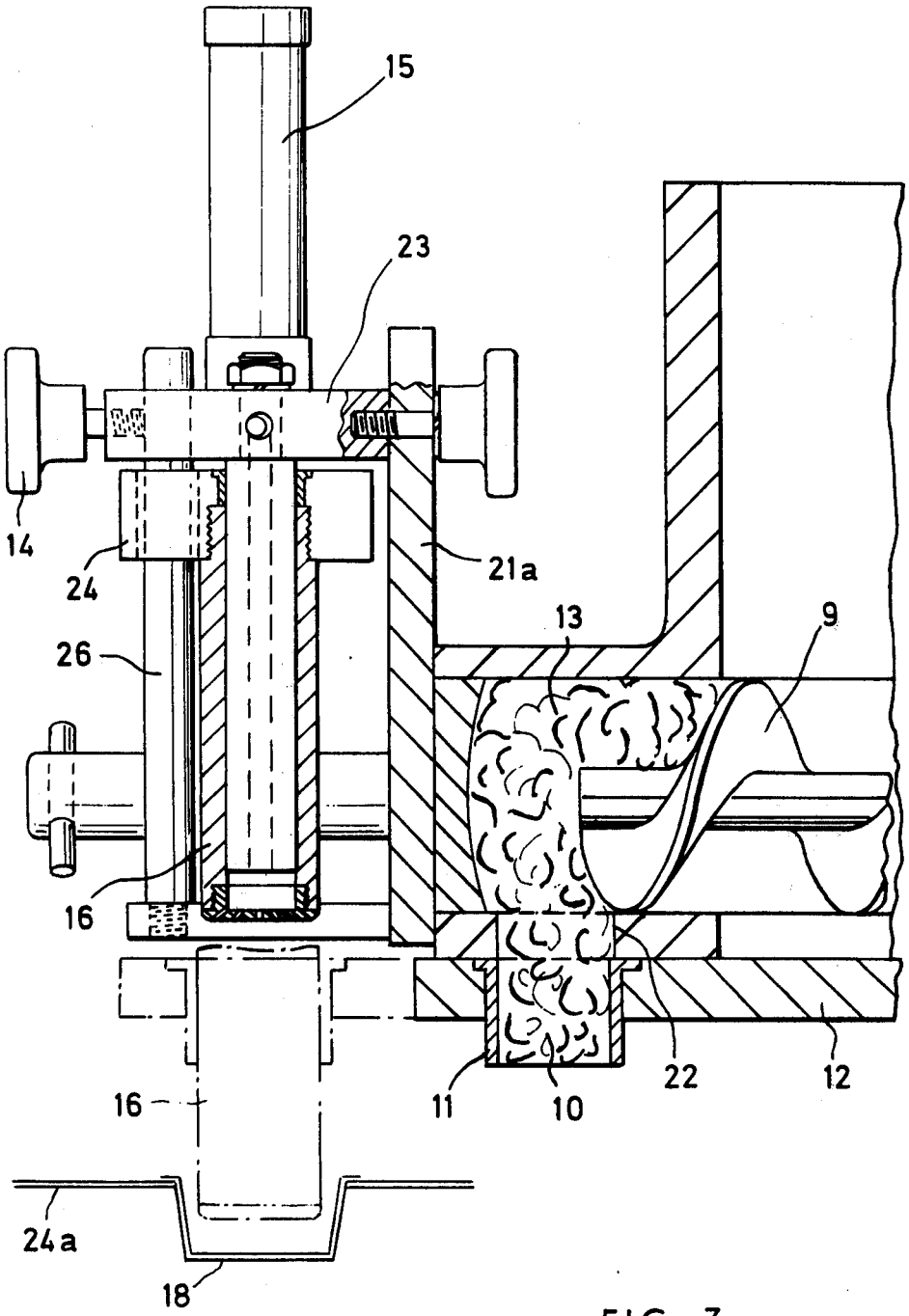
FIG. 3 is a part longitudinal cross-sectional view of an embodiment of apparatus according to the invention.

The feed roll 8 and screw extruder 9 are mounted in a housing 21 and as shown in FIG. 3 the screw 9 and feed roll 8 operate to feed a material 13 to be extruded to one end of the housing 21. The material is extruded through an opening 22 provided in the base of the housing 21 and is received in a tubular receiving member 11 mounted in a movable slide member 12. The slide member 12 is mounted for movement in close-fit contact with the base of housing 21 so that when a predetermined portion of material 10 has been extruded into member 11 movement of the slide member shears the portion 10 from the main mass of material 13 within the housing 21. When the divided portion is separated from the main mass the screw 9 is not rotating so that there is no mixing of the material.

An ejecting mechanism for ejecting the portion 10 from the slide member 12 is mounted to the extruder mechanism as shown in FIG. 3. The ejecting mechanism comprises an air cylinder 15 for actuating a piston 16. Vertical movement of the piston 16 is guided by a stabilizing guide rod 26 to which the piston is slidingly attached via a guide block 24.

The piston 16 and associated actuating cylinder are mounted on a cross member 23. The cross member 23 is mounted for verticle adjustment on a support 21a which is attached to the extruder mechanism, and the guide rod 26 by means of adjusting members 14.

The free end of the piston 16 is provided with a perforated cap 17 to permit a blast of air to be released therethrough at a required time during operation of the ejecting mechanism.

When the portion of extruded material 10 is to be ejected from the slide member 12, the slide member is moved to shear the portion from the main mass 13 and to convey the portion to the ejecting mechanism. The position of the slide member 12 is shown in dotted lines in FIG. 3 at an ejecting position whereat when piston 16 is actuated by air cylinder 15 it expels the portion from the tubular receiving means 11 and into a container 18 disposed on a conveyor system 24*a*. The path of travel of the piston 16 can be so regulated that subsequent movement threreof after expelling the portion 10 from the slide member 12 enables the piston to compact the portion of extruded material in the container 18. The degree of compaction is varied by means of the adjusting members 14. This effectively regulates the distance of travel of the piston 16 with respect to the position of the container 18 on the conveyor 24*a*.

Figure 2:
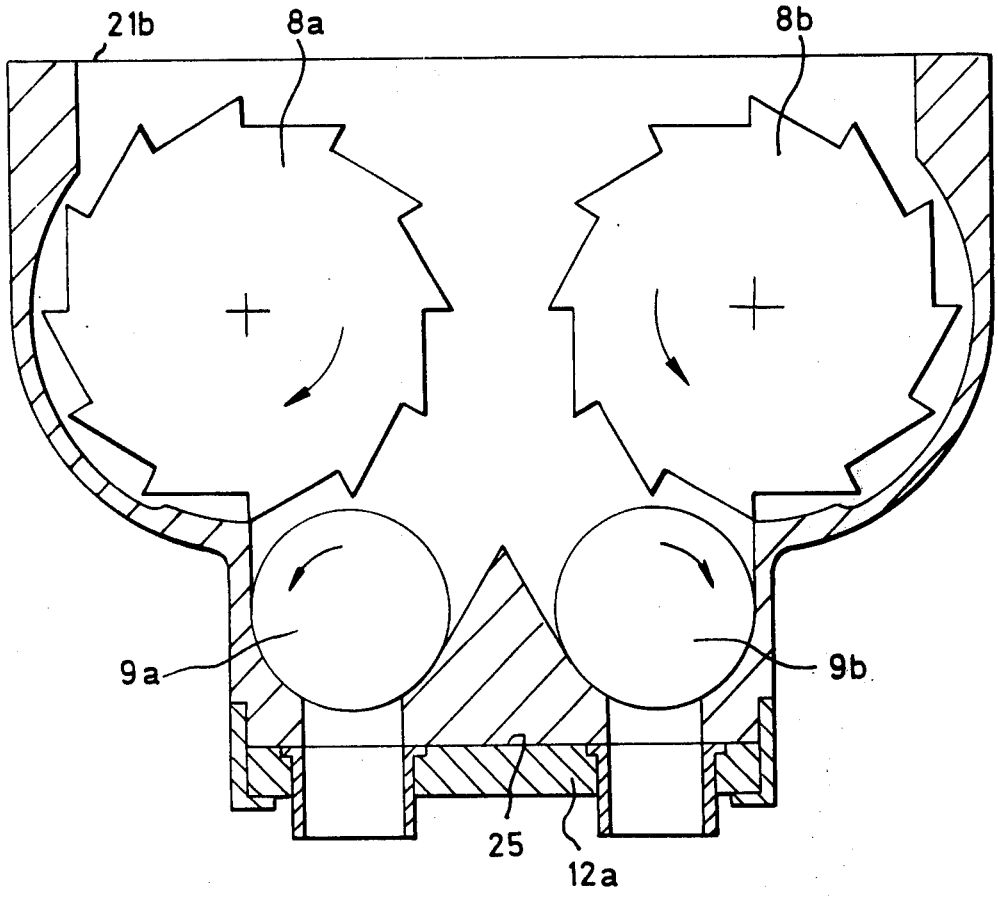
FIG. 2 is a cross-sectional view of an extruder mechanism.

A cross-sectional view of an extruder mechanism is shown in FIG. 2. Here a pair of screw extruders 9*a* and 9*b* are provided in working relationship with a pair of feed rolls 8*a* and 8*b* and mounted within a housing 21*b*.

A slide member 12*a* is mounted in close-fit movable contact with the base 25 of the housing 21*b* and incorporates a pair of tubular receiving members 11*a* for receiving portions of material 10 extruded from the material 13 within the housing 21*b*.

Figure 4:
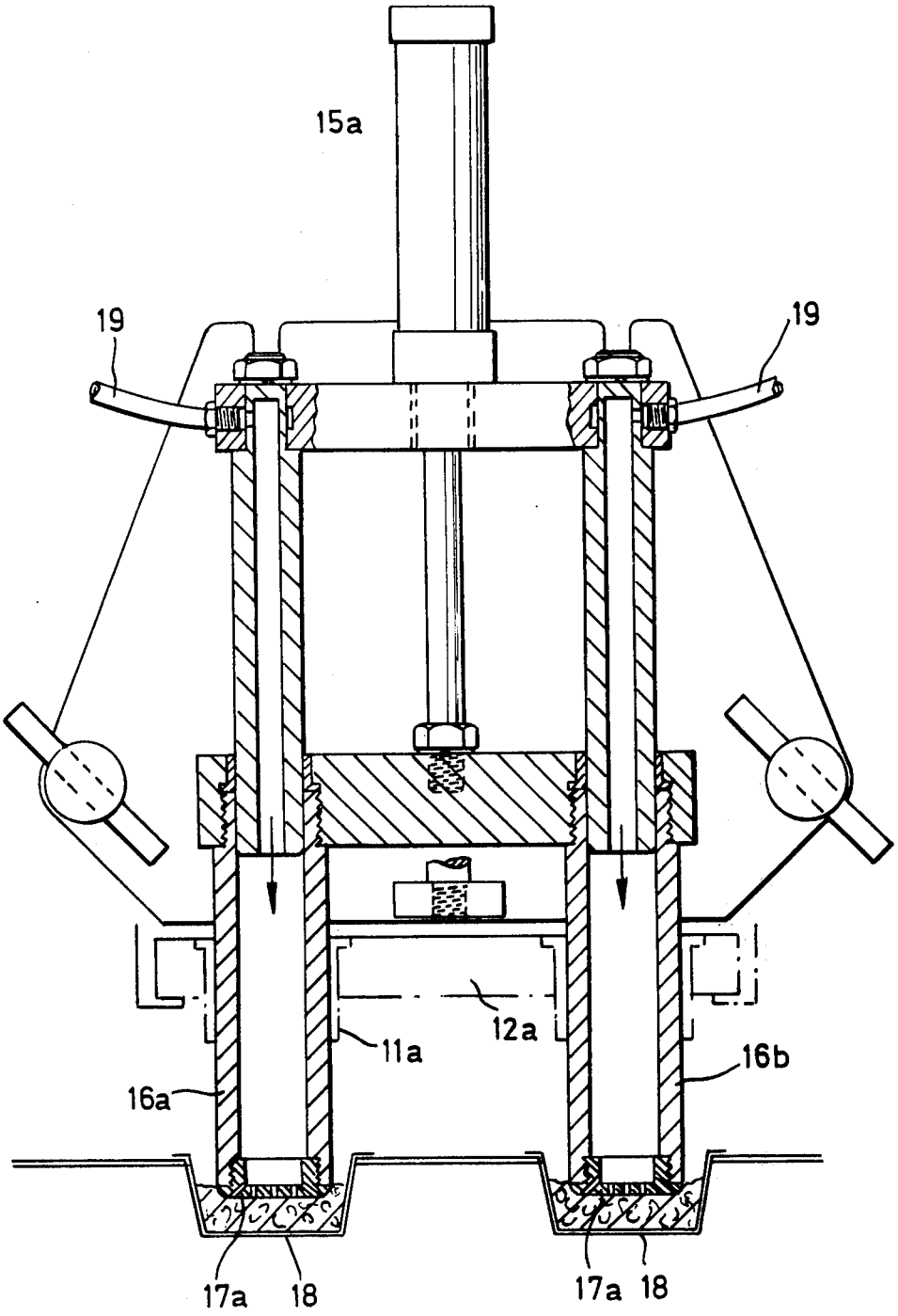
FIG. 4 is a modification of the ejecting device depicted in FIG. 3.

The twin screw and feed roll extruder mechanism as shown in FIG. 2 may be used with a twin ejecting mechanism shown in FIG. 4. This mechanism incorporates a pair of pistons 16*a* and 16*b* actuated by means of air cylinder 15*a*. The slide member 12*a* moves from a position with respect to the extruder mechansim of FIG. 2 whereat to receive a portion of extruded material in the respective tubular receiving members 11*a*, to an ejecting position with respect to the ejecting mechanism shown in FIG. 4. Thereupon the pistons 16*a* and 16*b* are actuated to expel the extruded material from the slide 12*a* into the containers 18 and compact the material therein. The pistons 16*a* and 16*b* are shown in their compacting positions in FIG. 4.

Supply pipes 19 feed clean air to the pistons 16*a* and 16*b* and consequently through perforated caps 17*a* mounted at their free ends.

The ejecting mechansim shown in FIG. 4 is attachable to the extruder mechanism of FIG. 2 by wing plates 20.

During an operating cycle of the apparatus as above described the air cylinder 2 as shown in FIG. 1 is controlled for operation for a predetermined time.

The clutch 4 is then engaged for this predetermined time by the air cylinder 2 and the amount of material extruded is adjustable through this time preset.

After the predetermined time has elapsed the slide member 12 or 12*a* is moved together with its contained material portion forward to the ejecting position. When the slide member is correctly positioned the ejecting mechanism is actuated and the slide then returns to the extruding position for a further operating cycle.

One of the main advantages of the foregoing operation is that the connective sinews are sheared or separated twice, once by movement of the divided portion from the main mass and once by the piston moving through the tubular receiving means connected to the slide member. The latter movement frees any sinews caught between the faces of the slide.

I claim:

1. Apparatus for depositing a predetermined amount of material such as meat into a container comprising a housing having a discharge opening in one side thereof, extrusion means in said housing for extruding a predetermined portion of material from a mass of material in said housing through said opening, slide means mounted for sliding movement across said one side of said housing between a receiving position and an ejecting position, an open ended tubular receiver mounted on said slide means to be located with one end of said receiver in sealed registry with said opening when said slide means is in said receiving position to receive said portion of material from said container means, both open ends of said receiver being exposed when said slide means is in said ejecting position, and reciprocal piston means aligned with said receiver when said slide means is in said ejecting position and movable from a retracted position spaced from one end of said receiver entirely through said receiver to a location spaced a preselected distance beyond the opposite end of said receiver to eject said portion of material from said receiver into the container, and means for adjusting the length of stroke of said piston means to establish said preselected distance.

* * * * *